US006008482A

United States Patent [19]

Takahashi et al.

[11] Patent Number: 6,008,482

[45] **Date of Patent: *Dec. 28, 1999**

[54] MICROWAVE OVEN WITH INDUCTION STEAM GENERATING APPARATUS

[75] Inventors: Yutaka Takahashi, Nara; Keijirou Kunimoto, Nabari; Daisuke Bessyo, Kitakatsuragi-gun; Akio Tajima, Kashihara, all of Japan

[73] Assignee: Matsushita Electric Industrial Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/817,583

[22] PCT Filed: Oct. 23, 1995

[86] PCT No.: PCT/JP95/02177

§ 371 Date: May 28, 1997

§ 102(e) Date: May 28, 1997

[87] PCT Pub. No.: WO96/13138

PCT Pub. Date: May 2, 1996

[30] Foreign Application Priority Data

| | | | |
|---|---|---|---|
| Oct. 24, 1994 | [JP] | Japan | 6-258140 |
| Jun. 22, 1995 | [JP] | Japan | 7-155891 |
| Jun. 22, 1995 | [JP] | Japan | 7-155892 |
| Jun. 22, 1995 | [JP] | Japan | 7-155919 |

[51] Int. Cl.[6] ..... H05B 6/10; H05B 6/80

[52] U.S. Cl. ..... 219/687; 219/601; 219/682; 219/629; 219/667

[58] Field of Search ..... 219/682, 687, 219/688, 628, 629, 630, 401, 667, 710, 718, 601

[56] References Cited

U.S. PATENT DOCUMENTS

| | | | |
|---|---|---|---|
| 2,407,562 | 9/1946 | Lofren | 219/629 |
| 2,494,716 | 1/1950 | McMahon et al. | 219/630 |
| 4,089,176 | 5/1978 | Ashe | 219/629 |
| 4,288,674 | 9/1981 | Councell | 219/687 |
| 4,341,936 | 7/1982 | Virgin | 219/630 |
| 4,366,357 | 12/1982 | Satoh | 219/682 |
| 4,431,890 | 2/1984 | Ramer | 219/629 |
| 4,449,026 | 5/1984 | Satoh | 219/682 |
| 4,560,849 | 12/1985 | Migliori et al. | 219/629 |
| 5,286,942 | 2/1994 | McFadden et al. | 219/630 |
| 5,350,901 | 9/1994 | Iguchi et al. | 219/630 |
| 5,525,782 | 6/1996 | Yoneno et al. | 219/682 |

FOREIGN PATENT DOCUMENTS

| | | | |
|---|---|---|---|
| 986303 | 7/1951 | France | 219/630 |
| 2 713 871 | 6/1995 | France . | |
| 414 920 | 6/1925 | Germany . | |
| 27 12 728 | 9/1978 | Germany . | |
| 347650 | 10/1929 | United Kingdom . | |
| 1 035 224 | 7/1966 | United Kingdom . | |
| 1 035 225 | 7/1966 | United Kingdom . | |

OTHER PUBLICATIONS

IBM Technical Disclosure Bulletin, vol. 14, No. 10, Mar. 1, 1992, New York.

*Primary Examiner*—Philip H. Leung
*Attorney, Agent, or Firm*—McDermott, Will & Emery

[57] ABSTRACT

A steam generating apparatus includes a chamber defining structure for defining a heating chamber for heating a fluid medium such as liquid and/or air; an exciting coil mounted on the chamber defining structure so as to surround the heating chamber and operable, when electrically energized by application of an alternating current power thereto, to produce an alternating magnetic field; a porous heating element disposed within the heating chamber, said porous heating element having a high porosity and adapted to be heated by an induction current developed by the alternating magnetic field produced by the exciting coil; and a liquid supply system for supplying a liquid medium to the heating chamber to allow the liquid medium to be heated in contact with the porous heating element to thereby produce steam.

9 Claims, 11 Drawing Sheets

81
82
83
Detector
Oven Control
87
94
85
84
86
80
88
17
18
23
15

81
82
83
Detector
Control
87
85
94
93
89
84
86
80
88
17
18
23

MICROWAVE OVEN WITH INDUCTION STEAM GENERATING APPARATUS

TECHNICAL FIELD

The present invention relates to the production of heated fluid medium such as steam of a kind utilizable on an industrial scale or at home for thawing frozen food materials, for creating a highly humid atmosphere during cooking, bread making or any other food processing, for air-conditioning, for performing a steam-assisted ironing or for sterilizing. More specifically, the present invention relates to a steam generating apparatus of an induction heating system for producing the heated fluid medium such as steam of the kind referred to above.

BACKGROUND ART

The steam generating apparatus for producing steam from water by an induction heating system is well known in the art. FIG. 20 of the accompanying drawings illustrate a longitudinal sectional view of the prior art steam generator such as disclosed in the Japanese Laid-open Patent Publication No. 4-51487, published in 1992. Referring to FIG. 20, the steam generator 1 includes an iron core 2 around which an electroconductive wire is would to form an induction coil 3. A steam generating tank 5 having its bottom formed by an iron plate 4 capable of creating a magnetic flux circuit is mounted atop the iron core 2 with the iron plate 4 resting on the iron core 2. The prior art steam generator 1 also includes a fluid supply means comprising a water spraying pipe 6 for spraying water onto the iron plate 4 within the steam generating tank 5 and a water supply pump 7, and a steam discharge means comprising a steam discharge pipe 9 having a needle valve 8 disposed thereon. The induction coil 3 referred to above is electrically connected with a commercial AC power source providing an alternating current power of a utility frequency. In this prior art steam generator 1, the iron plate 4 defining the bottom of the steam generating tank 5 serves as a heating element.

Another prior art heating element for heating water or air is disclosed in, for example, the Japanese Laid-open Patent Publication No. 3-98286, published in 1991, and is shown in FIGS. 21 and 22 of the accompanying drawings. Referring to FIGS. 21 and 22, the heating element comprises a generally cylindrical hollow column 10 of insulating material around which a coil 11 is formed, and a laminated filler 13 accommodated within the hollow of the column 10. The laminated filler 13 is made up of a plurality of generally elongated base members 12 each formed with a number of corrugations 4-1, which base members 12 are laminated together with the corrugations in one base member 12 laid so as to intersect the corrugations in the neighboring base member 12. In this structure, when an alternating current is supplied to the coil 11, eddy currents are produced in the laminated filler 13 to allow the latter to evolve heat. Air or liquid flowing through the column 10 as shown by the arrows is heated in contact with the laminated filler 13 then heated in the manner described above.

According to the prior art steam generator shown in FIG. 20, the heating element used as a bottom of the steam generating tank 5 flat, having its opposite surfaces parallel to each other, and has a relatively small surface area at which heat exchange takes place. Therefore, the amount of heat supplied per unitary surface area, that is, the amount of the fluid medium vaporized, is limited. In order to increase the amount of the fluid medium vaporized, the surface area of the heating element must be increased, resulting in increase of the size of the steam generator as a whole.

Also, the metallic material forming the heat element has a substantial thickness and is bulky in terms of heat capacity, exhibiting a relatively low response to heat. For this reason, the amount of the fluid medium vaporized cannot be controlled accurately.

Moreover, since the heating element is disposed at the bottom of the steam generating tank, not only is the prior art steam generator unable to heat the steam once produced to produce steam of an increased temperature, but also the heating speed at which the steam is heated cannot be controlled.

In the case of the heating element in which the laminated filler is employed, the base members forming the laminated filler are electrically coupled with each other through points of intersection between the corrugations 4-1 and 4-2 in the neighboring base members and, therefore, the laminated filler is susceptible to a localized heating that takes place at the points of intersections of the corrugations under the influence of the induction current. For this reason, the heating element utilizing the laminated filler is difficult to accomplish an efficient induction heating.

In addition, since the heating element is designed to heat only liquid or air, no simultaneous or selective production of steam and hot air is possible although only steam or hot air can be produced.

DISCLOSURE OF THE INVENTION

The present invention is aimed at substantially eliminating the above discussed problems and is intended to provide an improved steam generating apparatus compact in size and effective to efficiently and stably produce a steam with or without a heated gas.

Another object of the present invention is to provide an improved steam generating apparatus of the type referred to above, which is effective to produce the heated fluid medium of a characteristic suited for a particular purpose of use such as, for example, humidifying, drying, cooking and sterilizing.

A further object of the present invention is to provide an improved steam generating apparatus of the type referred to above, wherein a single heating means is employed to efficiently produce steam and hot air simultaneously or separately.

Considering that a diversity of cooked food items are available including oil-treated foods such as fried foods and tempura, vegetables such as green vegetables and boiled vegetables, stewed foods and steamed foods, mere microwave heating is unable to draw the taste of the foods end also to accomplish a preservation of nutrients of the foods.

Accordingly, a different object of the present invention is to provide an improved microwave heating system comprising a microwave heating oven and the steam generating apparatus.

It is also a related object of the present invention to provide an improved microwave heating system of the type referred to above, wherein even where a frozen food of a varying shape and of a varying constituent is to be heat-treated within a microwave heating chamber, provision is made to eliminate any possible uneven heating which would otherwise result from the difference in microwave absorption characteristic of the frozen food material and also to provide an excellent thawing capability.

In order to accomplish these and other objects of the present invention, according to one aspect of the present invention, a steam generating apparatus includes a chamber defining structure for defining a heating chamber for heating a fluid medium such as liquid and/or air; an exciting coil mounted on the chamber defining structure so as to surround the heating chamber and operable, when electrically energized by application of an alternating current power thereto, to produce an alternating magnetic field; a porous heating element disposed within the heating chamber and having a high porosity and adapted to be heated by an induction current developed by the alternating magnetic field produced by the exciting coil; and a liquid supply system for supplying a liquid medium to the heating chamber to allow the liquid medium to be heated in contact with the porous heating element to thereby produce steam.

The porous heating element may be made of either a porous metallic material or a fibrous metallic material, provided that the porous heating element can have a multiplicity of fine pores of an open-celled structure.

Preferably, the chamber defining structure is made of either insulating material or magnetizable material.

The porous heating element may preferably be of a generally cylindrical configuration having a longitudinally extending hollow defined therein. In such case, the chamber defining structure is made of insulating material, and a supply tube forming a part of the fluid supply means should extend into the hollow in the heating element for supplying the fluid medium into the heating chamber with the exciting coil mounted around the supply tube.

Preferably the fluid supply means may include a level control means for maintaining a surface level of the liquid medium within the heating chamber at a predetermined level.

If desired, a blower means for supplying a draft of air into the heating chamber, and a control means for controlling a supply of the electric power to the exciting coil, the fluid supply means and the blower means may incorporated in the steam generating apparatus. In such case, the control means may include a switching means for selecting one of a steam generating mode in which the heating means, the fluid supply means the blower means are simultaneously operated, a hot air generating mode in which the fluid supply means is inactivated and the heating means and the blower means are operated, and a fan mode in which only the blower means is operated. Alternatively, the control means may include a steam amount adjusting means for proportionally varying the amount of the electric power to be supplied to the exciting coil and the amount of the fluid medium to be supplied by the fluid supply means.

The control means may preferably include a temperature detecting means for detecting the temperature of stem or heated air of the heating means, and a steam amount adjusting means for varying the amount of heat generated by the heating means and the amount of the fluid medium supplied by the fluid supply means according to the temperature detected by the temperature detecting means. In such case, the control means operates to vary the amount of heat produced by the heating means according to one of the modes selected by the switching means.

According to another aspect of the present invention, the steam generating apparatus comprises a chamber defining structure for defining a heating chamber; an exciting coil mounted on the chamber defining structure so as to surround the heating chamber and operable, when electrically energized by application of an alternating current power thereto, to produce an alternating magnetic field; a heating element disposed within the heating chamber and including a heat radiating fin assembly capable of emitting heat when heated by an induction current developed by the alternating magnetic field produced by the exciting coil; and a fluid supply means for supplying a liquid medium to the heating chamber to allow the liquid medium to be heated in contact with the heat radiating fin assembly.

According to a further aspect of the present invention, there is provided a microwave heating apparatus which comprises an oven defining structure having a microwave heating chamber defined therein for accommodating an article to be hated; a microwave generating means for radiating microwaves into the microwave heating chamber to heat the article; a steam generating means for supplying steam into the microwave heating chamber; and a control means for controlling the microwave generating means and the steam generating means to adjust a condition inside the microwave heating chamber, and the article is heated by the microwaves and a high temperature of the steam introduced into the microwave heating chamber.

Where an air heating means for enhancing an increase in temperature inside the microwave heating chamber is additionally provided in the microwave heating apparatus of the type discussed above, the control means is operable to control the microwave generating means, the steam generating means and the air heating means to adjust a condition inside the microwave heating chamber, and the article is heated by the microwaves and a high temperature of an atmosphere inside the microwave heating chamber.

According to the present invention, a liquid medium from the fluid supply means is supplied into the heating chamber. After the supply of the liquid medium, and when an AC power is supplied to the exciting coil to energize the latter, magnetic lines of force developed by the energized exciting coil pass through the heating element. As the direction of the magnetic lines of force change according to the cycle of the applied AC power, electric force opposing to the change in direction of the magnetic lines of force are developed in the heating element, resulting in an induction current flowing in a direction counter to the direction of flow of the electric current through the exciting coil. By this induction current so developed, the heating element is heated and, at the same time, the liquid medium within the heating chamber is heated. As the heating proceeds, the liquid medium is vaporized and then emerges outwardly from the heating chamber as steam to a site at which the steam is utilized.

The chamber defining structure defining the heating chamber for heating the liquid medium and/or the gaseous medium is made of insulating material and, therefore, the magnetic field develops across the heating chamber so as to pass through the heating element. At the same time, the exciting coil and the heating element are electrically insulated from each other.

Where the heating chamber is of a tubular configuration having an annular space defined inwardly of an inner wall of the heating chamber and the heating element is accommodated within the annular space, and when liquid, steam and air are allowed to pass through a space between the inner wall of the heating chamber and a surface region of the heating element which is most heated by the induction current, a heat exchanging efficiency can be increased.

Where the chamber defining structure defining the heating chamber is made of magnetizable material with the heating chamber and the heating element integrated together, and when the AC power is supplied to the exciting coil positioned externally around the heating chamber, the resultant induction current will flow through the heating chamber itself to release heat by which liquid or air supplied into the heating chamber can be heated.

The liquid supplied through the fluid supply means cools the exciting coil when it flows through a liquid passage provided in the vicinity of the exciting coil disposed inside the heating chamber. The liquid used to cool the exciting coil is heated and then supplied into the heating chamber.

The heating element is made of the porous metallic material having a multiplicity of pores of an open-celled structure. Therefore, when the induction current flow through the skeleton of the heating element, the porous metallic material is heated to heat the liquid then held in contact with total surfaces of the skeleton of the heating element.

The porous metallic material forming the heating element immersed in water is a water-resistant, magnetizable porous metallic material made of, for example, Ni, Ni—Cr alloy or stainless alloy and will not corrode even when placed in a corrosive atmosphere such as a gas interface layer where corrosion occurs easily as a result of an increased concentration of leftovers left by evaporation at a high temperature. Thus, the porous metallic material is effective to vaporize water without being corroded.

The heating element may be made of the fibrous metallic material such as, for example, one or more wires coiled into a column shape. When the induction current flow through the fibrous metallic material, fine wire elements forming the fibrous metallic material are heated so that the entire surfaces of the fine wire elements can be utilized to vaporize water held in contact therewith.

Where the heating element is of a generally tubular configuration having a longitudinally extending hollow in which the heat radiating fin assembly is disposed, heat developed by the heating element as a result of the induction current can be transmitted to fins forming the radiating fin assembly which in turn heat air and liquid at a high heat-exchanging efficiency.

Where the width of the tubular heating element is chosen to be of a value sufficient to allow the developed magnetic field to reach, the induction current can flow through the tubular heating element in its entirety, accomplishing the heating of the heating element at a high efficiency.

Supply of the liquid from the fluid supply means onto the heating element may be carried out either dropwise or in a sprayed fashion. In either case, the liquid and/or the air when brought into contact with the heated heating element vaporizes quickly and/or is heated quickly within the heating chamber.

If the amount of the liquid supplied into the heating chamber is relatively large for the given AC power supplied to the exciting coil, the steam produced within the heating chamber has a relatively high liquid content and, conversely, if the amount of the liquid supplied is relatively small for the given AC power, the steam is further heated to have a high dryness.

The fluid supply means supplied the liquid to a predetermined level within the heating chamber by the operation of the level control means. When the heating chamber is filled with liquid, and the AC power is subsequently supplied to the exciting coil, the induction current is induced in the heating element to heat the latter and in turn the liquid to produce steam.

If the level of the liquid within the heating chamber is higher than the heating element, the resultant steam will have a high water content. On the other hand, if the level of the liquid within the heating chamber is lower than the heating element, the resultant steam is again heated by a portion of the heating element protruding outwardly from the level of the liquid within the heating chamber and will have a low water content, that is, a steam of a high dryness.

Where the steam generating apparatus of the present invention is provided with the blower means and the control means for controlling the supply of the AC power to the exciting coil and the fluid supply means, generation of steam, a mixture of steam and hot air and hot air is possible one at a time. For this purpose, the control means may be designed so as to select one of a steam generating rating mode in which the heating means, the water supply means the blower means are simultaneously operated, a hot air generating mode in which the water supply means is inactivated and the heating means and the blower means are operated, and a fan mode in which only the blower means is operated.

If the steam generating apparatus of the present invention is incorporated in a microwave oven, one of a steam heating of a food material at a relatively low temperature of 60 to 70° C., a steam heating of a good materiel at a medium temperature of about 100° C., and a dry steam heating of a food material at a relatively high temperature of 150 to 200° C. can be selectively accomplished. As a matter of course, the amount of steam to be supplied into the microwave heating chamber can be adjusted to suit to the kind and/or the quantity of the food material to be heat-treated.

BRIEF DESCRIPTION OF THE DRAWINGS

These and other objects and features of the present invention will become clear from the following description taken in conjunction with preferred embodiments thereof with reference to the accompanying drawings, in which like parts are designated by like reference numerals and in which.

BEST MODE FOR CARRYING OUT THE INVENTION

Figure 1:
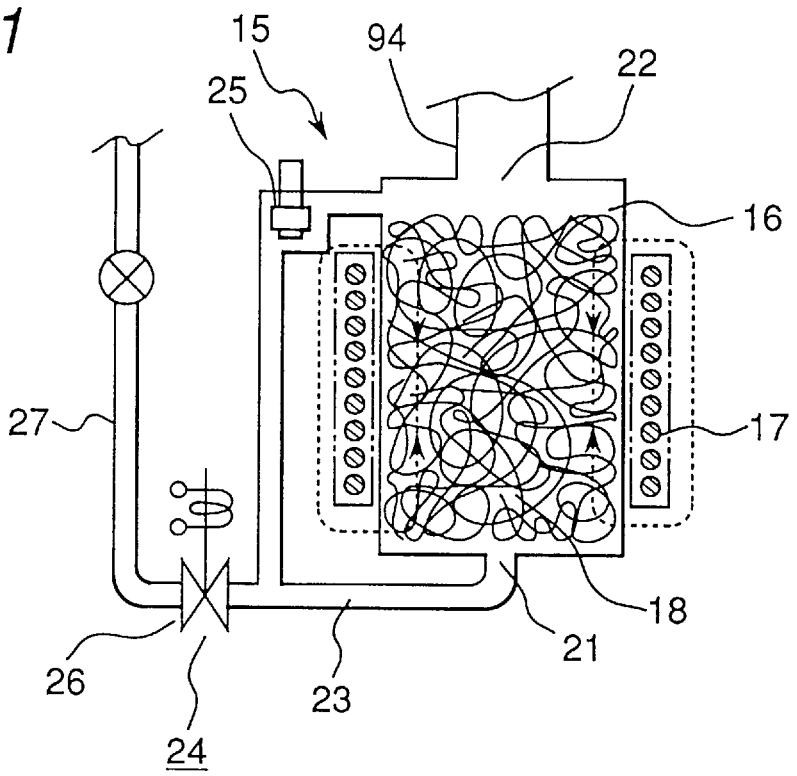
FIG. 1 is a schematic longitudinal sectional view of a steam generator according to a first preferred embodiment of the present invention.
Figure 2:
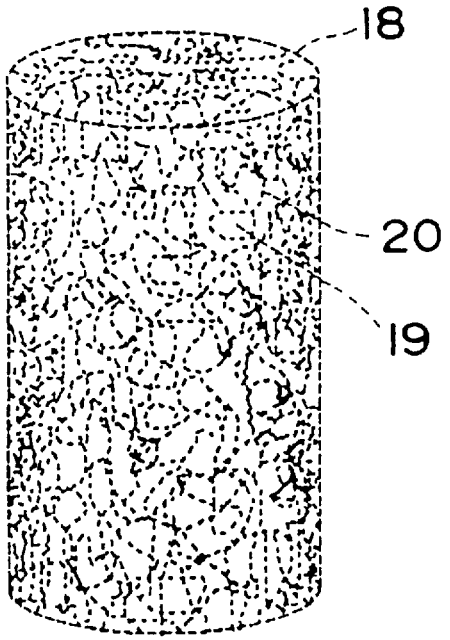
FIG. 2 is a schematic perspective view of a porous heating element employed in the steam generator shown in FIG. 2.

Referring first to FIGS. 1 and 2 showing a first preferred embodiment of the present invention, a steam generator generally identified by 15 comprises a generally cylindrical wall made of insulating material and defining a heating chamber 16, an exciting coil 17 formed externally around the cylindrical wall defining the heating chamber 16, and a porous heating element 18 accommodated within the heating chamber 16 and adapted to provide a magnetic circuit for a magnetic field which would be produced when the exciting coil 17 is excited. The heating chamber 16 has an inflow port 21 defined at the bottom thereof and, also, an outflow port 22 defined at the top thereof. The inflow port 21 is fluid-coupled with a water supply means 24 through an inflow tube 23 and then through a connecting pipe 27 to a source of water which may be a pump-equipped water reservoir or a commercial water supply outlet. On the other hand, the outflow port 22 is fluid-coupled with a discharge tube 94. The water supply means 24 referred to above includes a level sensor 25 for detecting, and outputting a level signal indicative of, a surface level of water within the heating chamber 16 and a flow control valve 26 for selectively opening and closing a water flow path in dependence on the level signal fed from the level sensor 25.

As best shown in FIG. 2, the porous heating element 18 within the heating chamber 16 is of a shape, for example, cylindrical so far illustrated, conforming to the shape of the heating chamber 16 and is made of a porous metallic material of an open-celled structure having mutually communicated pores 19 left by mutually connected fine wire elements 20 and also having a relatively high porosity. An example of the open-celled porous metallic material includes a sponge-like metallic material of a kind tradenamed "CELMET" available from Sumitomo Electric Industries, Ltd. of Japan. The use of the sponge-like metal for the porous heating element 18 is preferred in the practice of the present invention. The CELMET material has a porosity ranging generally from 88 to 98% and is manufactured by subjecting a resinous foam, which has been suitably treated so as to have an electroconductivity, to an electroplating process using Ni, Ni—Cr alloy, stainless alloy or any other metal or metallic alloy having a high resistance to corrosion, followed by a heat-treatment to melt out the resinous foam material to thereby leave the sponge-like metal of an open-celled structure.

Where the CELMET material is employed, and considering that the CELMET material currently available is being produced in the form of a web of, for example, 90 cm in maximum width and about 1 cm in thickness, the heating element 18 employed in the practice of the present invention is prepared by laminating a plurality of CELMET discs one above the other, the number of which may vary depending upon the desired length of the heating element 18.

Alternatively, a steel wool molded into a generally column shape or any other suitable shape conforming to the shape of the heating chamber 16 may also be used for the porous heating element 18.

Figure 3:
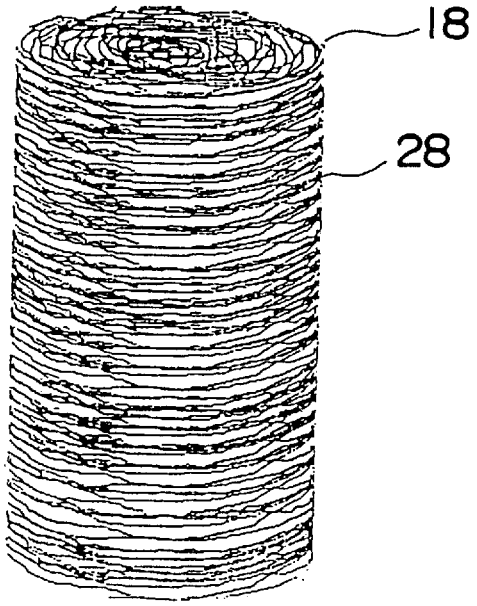
FIG. 3 is a schematic perspective view of a modified form of the porous heating element which may be employed in the steam generator shown in FIG. 1.

Again alternatively, as shown in FIG. 3, the porous heating element 18 may be prepared from one or more magnetizable wires 28 densely wound into a generally column shape or any other shape conforming to the shape of the heating chamber 16. Not only is the porous heating element 18 in the form of a column of coiled wires 28 inexpensive, but preparation of the porous heating element 18 from the wire or wires 28 can easily be accomplished since no special mold is needed to shape the heating element 18. In addition, the density of turns of the coiled wires 28 which form an outer peripheral region of the heating element 18 tending to be heated to a relatively high temperature by induction heating can easily be adjusted depending on the purpose for which the heating element 18 is used.

The steam generator 15 of the structure shown in and described with reference to FIGS. 1 and 2 operates in the following manner. Assuming that the flow control valve 26 is opened, water from the source of water is supplied into the heating chamber 16 through the inflow port 21 to a desired or required level within the heating chamber 16. When the top level of the water supplied into the heating chamber 16 reaches the desired or required level, the level sensor 25 generates a level signal with which the flow control valve 16 is switched to a closed position to interrupt the supply of water into the heating chamber 16.

On the other hand, when an AC power is supplied to the exciting coil 17 to energize the latter, magnetic field is produced around the exciting coil 17, the direction of which varies cyclically at a frequency matching with that of the AC power supplied to the exciting coil 17. Considering that the alternating magnetic field so produced passes through the heating element 18, electric forces develop in the heating element 18 to oppose the change of the magnetic field, thereby inducing electric currents (eddy currents) moving through the fine wire elements 20 in a direction counter to the direction of flow of the current through the exciting coil 17. The flow of the induced electric currents through the fine wire elements 20 forming the porous heating element 18 results in heating of the porous heating element 18.

Since the heating element 18 within the water-filled heating chamber 16 have its pores 19 filled up by the water, heating of the porous heating elements leads to heating of the water, and as the heating of the water proceeds, the water vaporizes to turn into steam which is subsequently discharged through the discharge tube 94 to a site of utilization of the steam.

According to the illustrated embodiment, since the porous heating element 18 in its entirety is immersed in water within the heating chamber 16 and is made of the porous metallic material having an extremely large surface area for heat dissipation, the steam can be produced at a relatively high steam producing speed with a substantially entire amount of the dissipated heat utilized at a high efficiency for the production of steam. Also, the heating chamber is made of insulating material and the electric field does not disturb formation of the magnetic circuit between the exciting coil and the heating element, making it possible to electrically insulate the heating element from the exciting coil.

Description similar to that above equally applies even where a column of steel wool or wires 28 is employed for the porous heating element 18.

Figure 4:
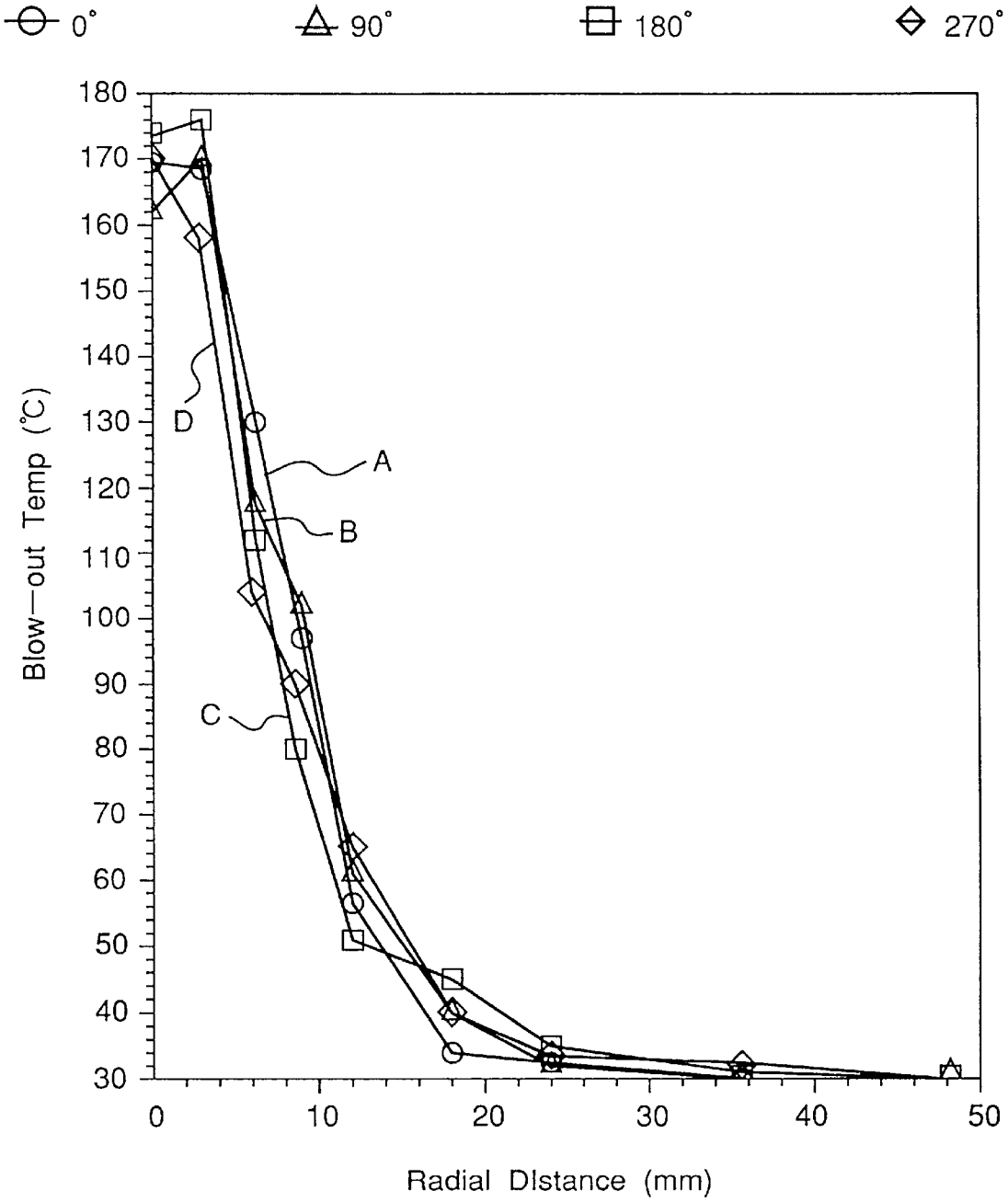
FIG. 4 is a graph showing a distribution of temperatures of steam produced by the porous heating element shown in FIG. 2, measured at various points spaced radially inwardly of the heating element.

Referring to FIG. 4, there is illustrated how deep the heating element 18, when used in the form of the column of "CELMET" material, was heated by the induction currents. In the graph of FIG. 4, the axis of abscissas represents the radial distance measured from a point on the outer periphery of the heating element 18 in a direction radially inwardly of such heating element 18 whereas the axis of ordinates represents the temperature of steam blown out from one end of the heating element with respect to each radial distance position. The graph of FIG. 4 also illustrates four interpolated curves A, B, C and D which represent temperature measurements obtained at a first point on the outer periphery of the heating element 18, at a second point on the outer periphery of the heating element angularly spaced 90° from the first point about the longitudinal axis of the heating element 18, at a third point on the outer periphery of the heating element angularly spaced 180° from the first point about the longitudinal axis of the heating element 18, and at a fourth point on the outer periphery of the heating element angularly spaced 270° from the first point about the longitudinal axis of the heating element 18, respectively.

Characteristics of the "CELMET" material as compared with those of a commercially available laminated plate available from Seta Giken Co., Ltd., of Japan, when both are used as a heating element of 96 mm in diameter and 50 mm in length for the purpose of the present invention, are tabulated below.

TABLE

| Items Tested | CELMET (#3 Ni) | Laminated Plate |
|---|---|---|
| Impedance at 25 kHz | ○ | X |
| Coil Inner L($\mu$H) | 39.7 | 38.3 |
| Diameter: R(Ω) 106 mm | 1.72 | 0.25 |
| Pressure Loss (mmAq) at 1 $m^3$/min | X 16 | ○ 1 |
| Water Retentivity (%) | ○ 27 | Δ 20 |
| Remarks | Coupling with the coil was satisfactory. The higher pressure loss can be compensated for by the physical design. | Coupling with the coil was not satisfactory. Not suited for use in the steam generator. |

Figure 5:
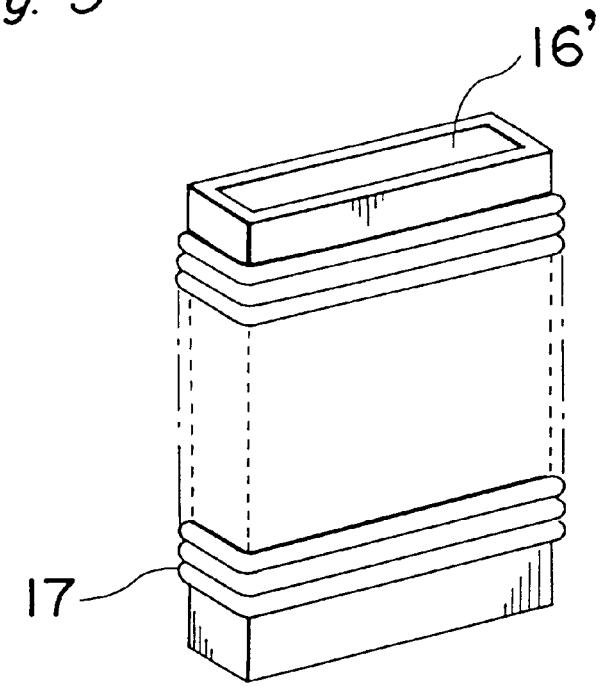
FIG. 5 is a schematic perspective view of the steam generator according to a second preferred embodiment of the present invention.
Figure 6:
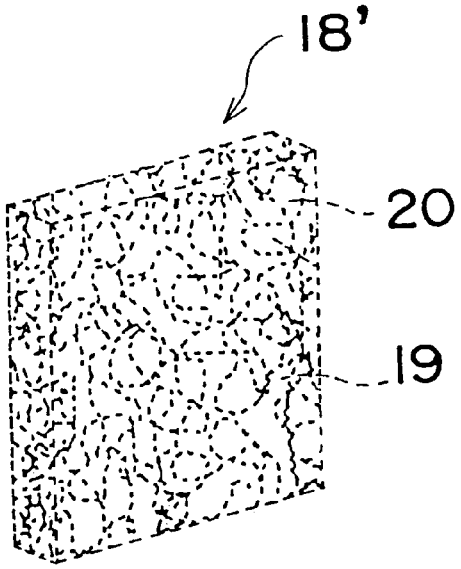
FIG. 6 is a schematic perspective view of the porous heating element employed in the steam generator shown in FIG. 5.

In the foregoing embodiment, the heating chamber 16 has been described as cylindrical in shape and the heating element 18 is correspondingly cylindrical. However, according to a second preferred embodiment of the present invention as shown in FIGS. 5 and 6, the steam generator comprises a generally rectangular-sectioned wall made of insulating material and defining a generally rectangular-sectioned heating chamber 16' accommodating therein a generally rectangular porous heating element 18' shaped to conform to the shape of the heating chamber 16'. As is the case with the foregoing embodiment, the exciting coil 17 is formed externally around the rectangular-sectioned wall defining the heating chamber 16'.

Even the steam generator according to the second preferred embodiment of the present invention functions in a manner similar to that according to the foregoing embodiment. In particular, however, depending on the particular application in which the steam generator is employed, the steam generator according to the second preferred embodiment of the present invention is effective to reduce the overall size of the apparatus in which the steam generator is incorporated. By way of example, considering that household microwave ovens of a design having a function of creating a humid atmosphere in the heating chamber are available in the market, the use of the steam generator shown in FIGS. 5 and 6 should contribute to reduction in size of such type of microwave oven since no unreasonably large space is required for installation therein.

Figure 7:
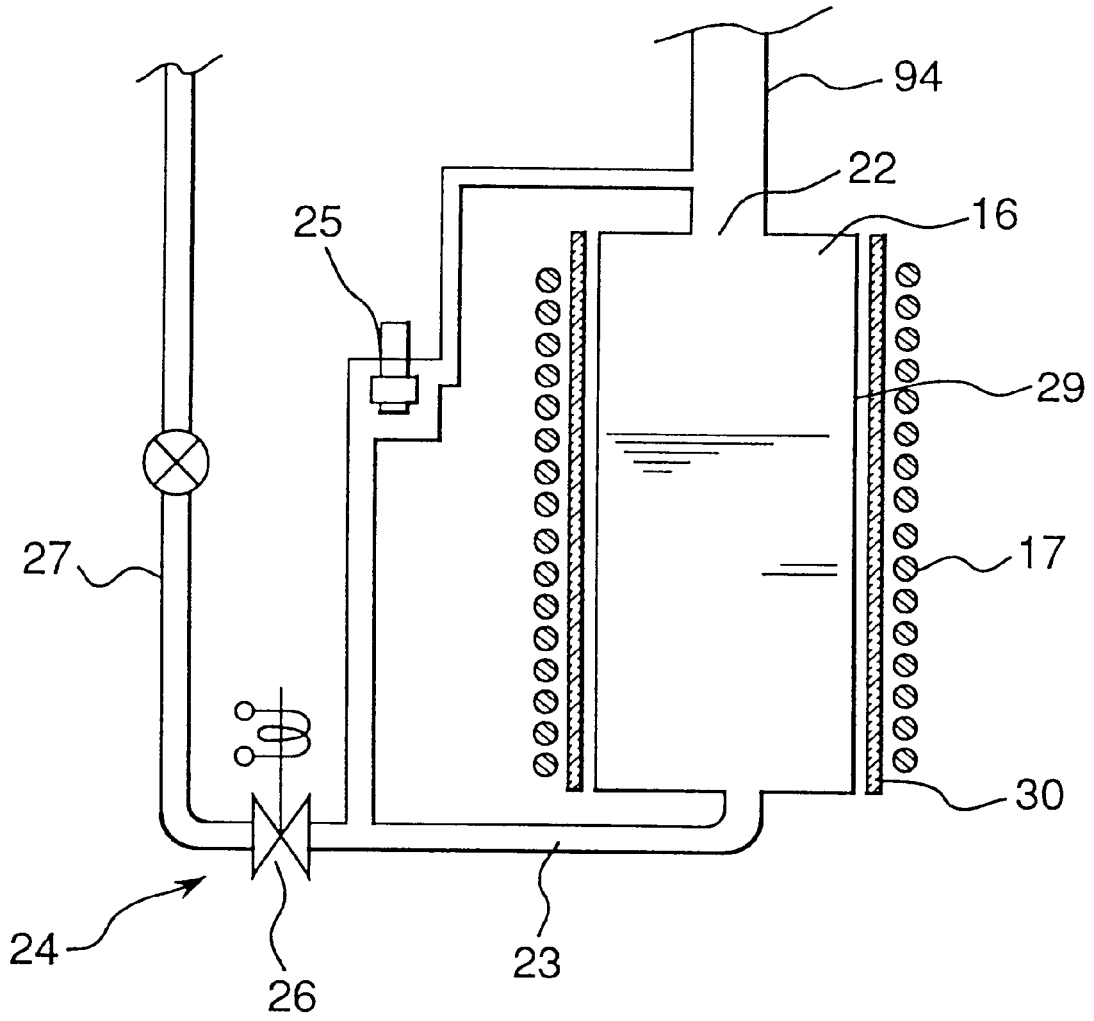
FIGS. 7 to 9 are schematic longitudinal sectional views of the steam generator according to third, fourth and fifth preferred embodiments of the present invention, respectively.

Referring now to FIG. 7 showing a third embodiment of the present invention, the steam generator shown therein comprises a generally cylindrical can 29 made of magnetizable material and defining therein the heating chamber 16. The heating chamber 16 has an inflow port 21 defined at the bottom thereof and, also, an outflow port 22 defined at the top thereof. The inflow port 21 is fluid-coupled with the water supply means 24 through an inflow tube 23 and then through a connecting pipe 27 to a source of water which may be a pump-equipped water reservoir or a commercial water supply outlet. On the other hand, the outflow port 22 is fluid-coupled with the discharge tube 94. The water supply means 24 referred to above includes a level sensor 25 for detecting, and outputting a level signal indicative of, a surface level of water within the heating chamber 16 and a flow control valve 26 for selectively opening and closing a water flow path in dependence on the level signal fed from the level sensor 25.

The exciting coil 17 formed externally around the cylindrical can 29 defining the heating chamber 16 with a cylindrical insulating barrel 30 intervening between the outer peripheral surface of the can 29 and the inner periphery of the exciting coil 17.

The steam generator 15 according to the third embodiment of the present invention shown in FIG. 7 operates in the following manner. Assuming that water from the source of water is supplied into the heating chamber 16 through the inflow port 21, and when an AC power is supplied to the exciting coil 17 to energize the latter, alternating magnetic field is produced around the exciting coil 17. This alternating magnetic field passes through the can 29 with the induction current consequently induced within the can 29. By this induction current, the can 29 itself is heated to heat and vaporize the water inside the heating chamber 16.

According to the third preferred embodiment of the present invention shown in FIG. 7, since the wall defining the heating chamber 16 is directly heated, no heating element such as required in any one of the foregoing embodiments is required, making it possible to assembly the steam generator at a reduced cost. Moreover, since the wall defining the heating chamber, that is, the can 29, is made of metallic material, a magnetic coupling with the exciting coil can be obtained easily and, therefore, it is possible to reduce the number of turns of the exciting coil 17 used and/or to reduce the diameter of the heating chamber.

Figure 8:
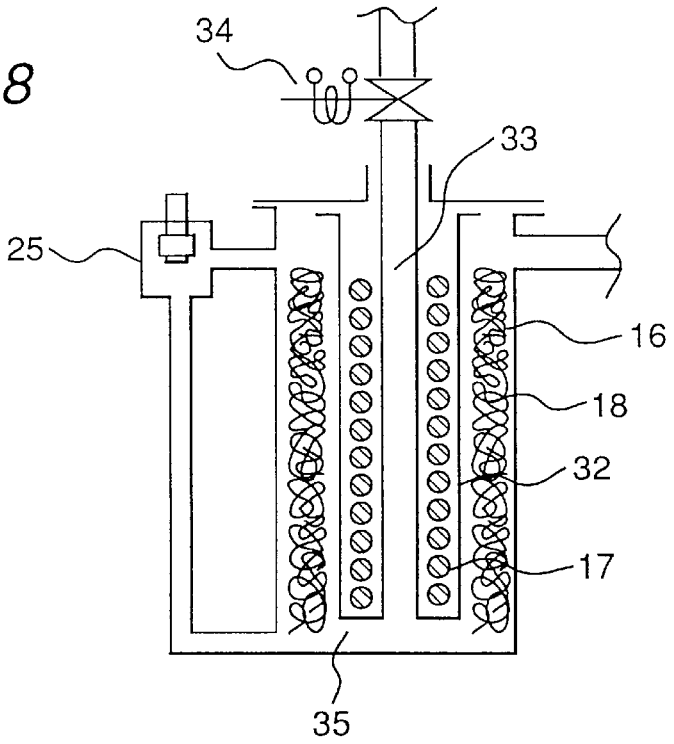

The steam generator according to a fourth preferred embodiment of the present invention is shown in FIG. 8. In this embodiment, the heating chamber 16 is defined by and between an outer barrel 31 and an annular inner barrel 32 accommodated within the outer barrel 31. The exciting coil 17 is accommodated inside the inner barrel 32 so as to encircle around an inflow pipe 33 coaxially extending into the inner barrel 32 while forming an inner peripheral wall of the inner barrel 32 and terminating at a position spaced a distance inwardly from the bottom of the outer barrel 31. One end of the inflow pipe 33 opposite to the bottom of the outer barrel 31 is communicated with a source of water through a flow control valve 34, whereas the other end of the inflow pipe 33 is communicated with an annular heating chamber 16 defined between the outer and inner barrels 31 and 32. Within this annular heating chamber 16, a porous heating element 18 of a substantially annular shape having a longitudinally extending hollow 39 is accommodated. One of longitudinal halves of said heating element 18 being shown in FIG. 10 and it will readily be seen that the heating element 18 shown therein is substantially similar to that shown in FIG. 2 except that the heating element 18 of FIG. 10 has a hollow 39 defined therein.

The steam generator according to the fourth embodiment of the present invention operates in the following manner. Assuming that water from the source of water is supplied into the inflow pipe 33, the water fills up the annular heating chamber 16, soaking the porous heating element 18 within the annular heating chamber 16. When an AC power is subsequently supplied to the exciting coil 17 to energize the latter, alternating magnetic field is produced around the exciting coil 17 to thereby induce an induction current flowing through the heating element 18. In this way, the heating element 18 is heated by the induction current in a manner similar to that described in connection with the first embodiment of the present invention to thereby heat and vaporize the water in the heating chamber 16. During the heating of the heating element 18, the exciting coil 17 absorbs Joule heat developed by the induction current and heat transmitted from the heating chamber 16 to cool the exciting coil 17 itself.

It is to be noted that although in FIG. 4 an inflow passage through which water enters the heating chamber 16 is defined by the inflow pipe 33 which also forms the inner peripheral wall of the inner barrel 32, the inflow passage may be defined along a wall member enclosing the exciting coil 17 and, in such case, the heating chamber may be defined inside an wall member around which the exciting coil 17 is mounted.

According to the fourth embodiment of the present invention, since the exciting coil 17 is cooled by the water having a high heat capacity, a relatively high electric power can be supplied to the exciting coil and this makes it possible to reduce the size of, and increase the capacity of, the apparatus in which the steam generator is employed.

Figure 9:
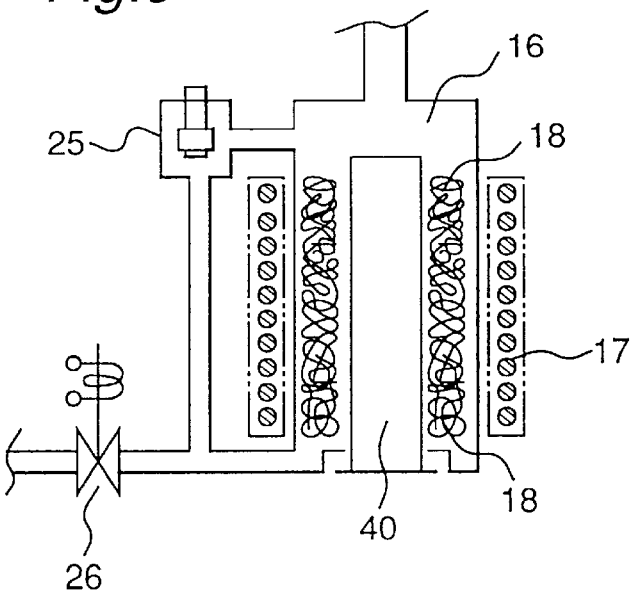
Figure 10:
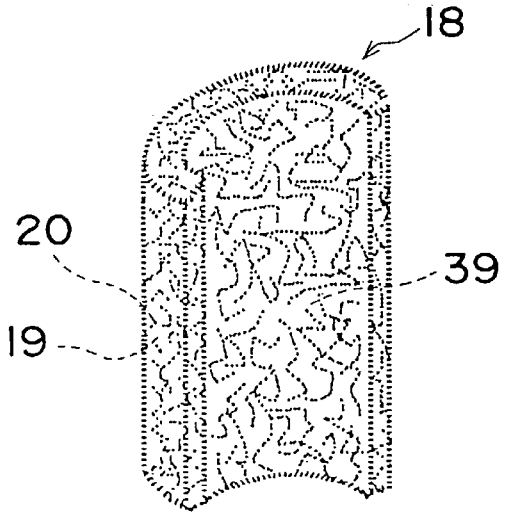
FIG. 10 is a schematic perspective view of a longitudinal half of the porous heating element employed in the steam generator shown in any one of FIGS. 8 and 9.

A fifth preferred embodiment of the present invention is shown in FIG. 9. In this embodiment of FIG. 9, the annular heating element 18 of the structure shown in FIG. 10 is employed. The annular heating element 18 is housed within the heating chamber 16 and positioned around a cylindrical insert 40 coaxially protruding into the heating chamber 16. The exciting coil 17 is formed externally around the cylindrical wall defining the heating chamber 16.

The steam generator according to the fifth embodiment of the present invention operates in the following manner. Assuming that water from the source of water is supplied into the annular heating chamber 16, the water fills up the annular heating chamber 16, soaking the porous heating element 18 within the annular heating chamber 16. When an AC power is subsequently supplied to the exciting coil 17 to energize the latter, alternating magnetic field passing through the annular heating element 18 is produced around the exciting coil 17 to thereby induce an induction current flowing through the fine wire elements 20 of the heating element 18. In this way, the heating element 18 is heated by the induction current in a manner similar to that described in connection with the first embodiment of the present invention to thereby heat and vaporize the water in the heating chamber 16.

According to the fifth embodiment of the present invention, since the heating element 18 is of a porous structure having an extremely high porosity, the area of surface contact between the heating element 18 and the water is extremely increased, making it possible to suppress the surface temperature of the heating element 18 to a relatively low value and to increase the amount of heat generated per unitary volume of the heating element 18. It is to be noted that since the width of the annular heating element 18 is chosen to be a value corresponding to the radial distance to which the alternating electric field reaches, the induction current flows through the annular heating element 18 in its entirety to heat the latter. Consequently, non-heated region of the heating element 18 is eliminated, the steam producing speed can be increased, and the annular heating element 18 can be made light-weight.

Figure 11:
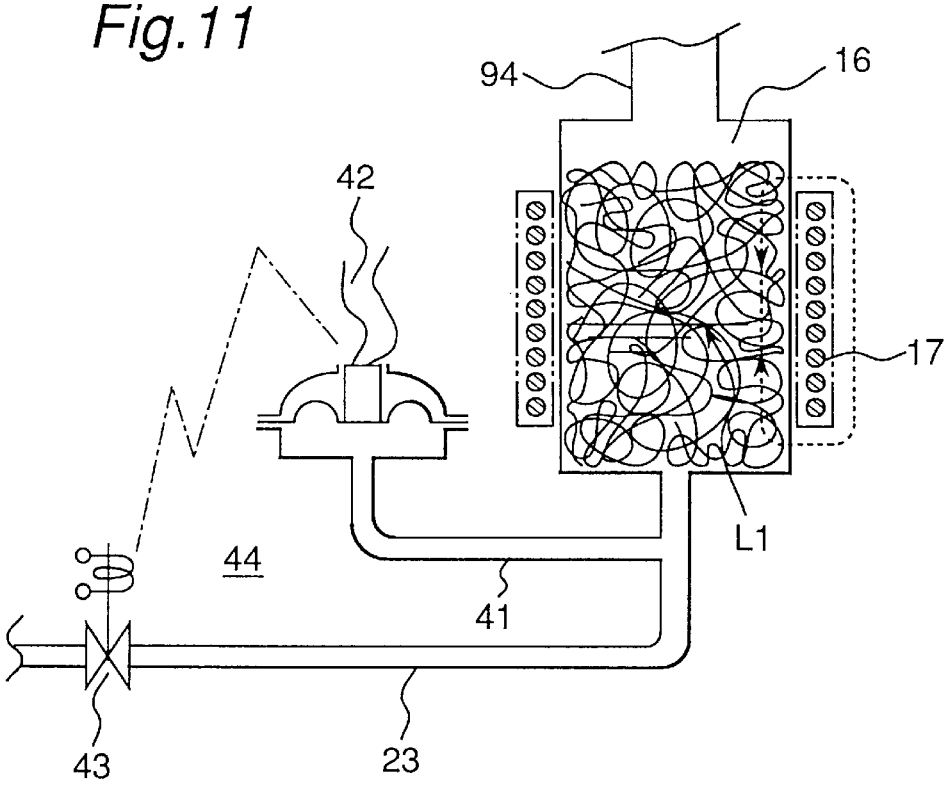
FIG. 11 is a schematic longitudinal sectional view of the steam generator, showing a modified form of a water supply means which may be employed in conjunction with any one of the first to fifth embodiments of the present invention.

A modified form of the water supply means 24 which may be employed in any one of the various embodiments of the present invention will now be described with particular reference to FIG. 11. The steam generator shown in FIG. 11 is substantially similar to that shown in FIG. 1. The water supply means shown in FIG. 11 includes a level control means 44 including a level sensing tube 41 branched off from a portion of the inflow tube 23 between the heating chamber 16 and a flow control valve 43, and a liquid level sensor 42 of, for example, a diaphragm type fluid-coupled with the level sensing tube 41 and capable of providing a signal used to control the flow control valve 43.

In the configuration shown in FIG. 11, water from the source of water is supplied into the heating chamber 16 through the inflow tube 23 during opening of the flow control valve 43. The level of the water within the heating chamber 16 is detected by the liquid level sensor 42 and, when the level of the water within the heating chamber 16 reaches a predetermined level indicated by L1, the supply of the water is interrupted in response to the signal from the liquid level sensor 41. On the other hand, when an alternating current is supplied to the coil 17 to energize the latter, alternating magnetic field passing through the annular heating element 18 is produced around the exciting coil 17 to thereby induce an induction current flowing through the fine wire elements 20 of the heating element 18. In this way, the heating element 18 is heated by the induction current in the manner described in connection with the first embodiment of the present invention shown in FIG. 1 to thereby heat and vaporize the water in the heating chamber 16. Vaporized water, that is, steam so produced, emerges outwardly through the discharge tube 94.

According to the modification shown in FIG. 11, since the predetermined level L1 is set at a position generally intermediate of the length of the heating element 18, the steam of a high dryness produced by heating and vaporizing the water within the heating chamber 16 can be obtained substantially instantaneously. Moreover, since the heating element 18 serves to concurrently heat and vaporize the water, a loss of heat during the vaporization and the steam heating can be minimized.

It is to be noted that the predetermined level L1 within the heating chamber 16 may be adjusted to any desired position by varying the operating parameter at which the flow control valve 43 is operated. With this liquid level control means 44, it is possible to adjust the proportion of the amount of steam produced and the extent to which the vapor is heated in the steam generator 15.

Figure 12:
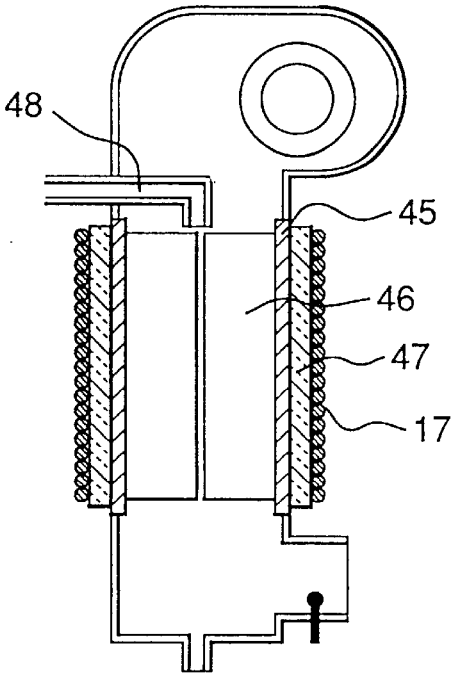
FIG. 12 is a schematic longitudinal sectional view of the steam generator according to a sixth preferred embodiment of the present invention in which the steam generator has dual functions of producing steam and hot air.
Figure 13:
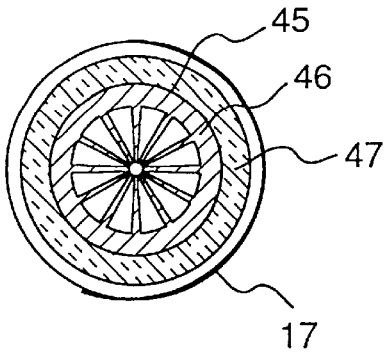
FIG. 13 is a transverse sectional view of the steam generator shown in FIG. 12.

Referring now to FIGS. 12 and 13, a sixth preferred embodiment of the present invention will be described. a generally cylindrical shell 45 defining the heating chamber is made of magnetizable metallic material such as a stainless alloy or the like and has a radial fin assembly 46 including a plurality of heat radiating fins disposed within the shell 45 so as to extend radially inwardly of the heating chamber. The exciting coil 17 is formed externally around the shell 45 with an insulating layer 47 interposed between the shell 45 and the exciting coil 17 so that, when an AC power is supplied to the exciting coil 17 to energize the latter, induction current can be induced in the heating chamber by the effect of electric field developed by the energized exciting coil 17 to allow the heating chamber to be heated. An inflow tube 48 having one end fluid-coupled with the source of water through a suitable pump (not shown) has the other end opening downwardly towards the radial fin assembly 46 so that the water can be supplied dropwise, or sprayed, into the heating chamber.

According to the sixth preferred embodiment of the present invention shown in FIGS. 12 and 13, when the AC power is supplied to the exciting coil 17 to create an alternating electric field around the exciting coil 17, the induction current is induced in the heating chamber. By the action of this induction current flowing through the heating chamber, the latter is heated. Accordingly, when the water is supplied dropwise or sprayed from the inflow tube 48 into the heating chamber, the water vaporizes and the resultant steam emerged outwardly from the bottom of the shell 45.

Dropwise supply or spraying of the water onto the heating element according to the embodiment shown in FIGS. 12 and 13 is effective to increase the steam producing speed. Moreover, since the amount of water dropped or sprayed and the amount of steam produced can easily be adjusted, a control of the amount of steam produced can easily be accomplished.

In addition, the provision of the radial fin assembly 46 in the path of flow of the dropwise supplied or sprayed water is effective to minimize a pressure loss and also to increase the heat-exchanging surface area to attain a high heat-exchange efficiency. Also, by the configuration wherein a portion of the induction current is formed in the shell external to the heating element by a skin effect and the radial fin assembly is disposed within the tubular heating element, the radial fin assembly does not bring about any adverse influence on the induction heating and the heat conducting surface area can be increased to attain a high heat-exchanging efficiency.

It is to be noted that although in the sixth embodiment shown in FIGS. 12 and 13, the heating chamber has been shown as constituted by the shell of magnetizable material provided with the radial fin assembly disposed therein, similar effects can be obtained even if the heating element comprised of a heating chamber and a heating element separate therefrom is employed.

Figure 14:
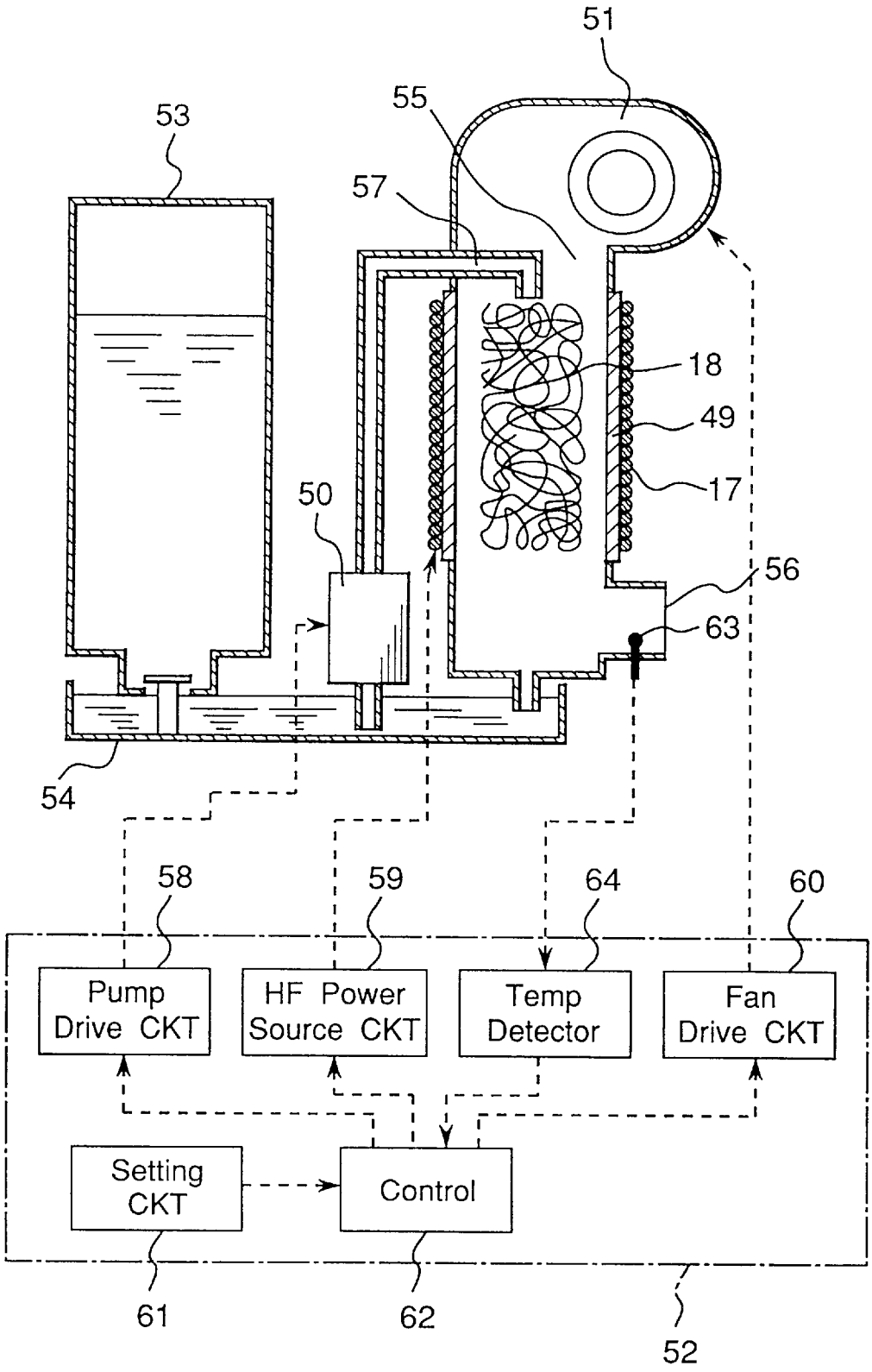
FIG. 14 is a schematic longitudinal sectional view of the steam generator according to a seventh preferred embodiment of the present invention, in which the steam generator has three operating modes of producing steam, producing hot air and producing a forced draft of air.
Figure 15:
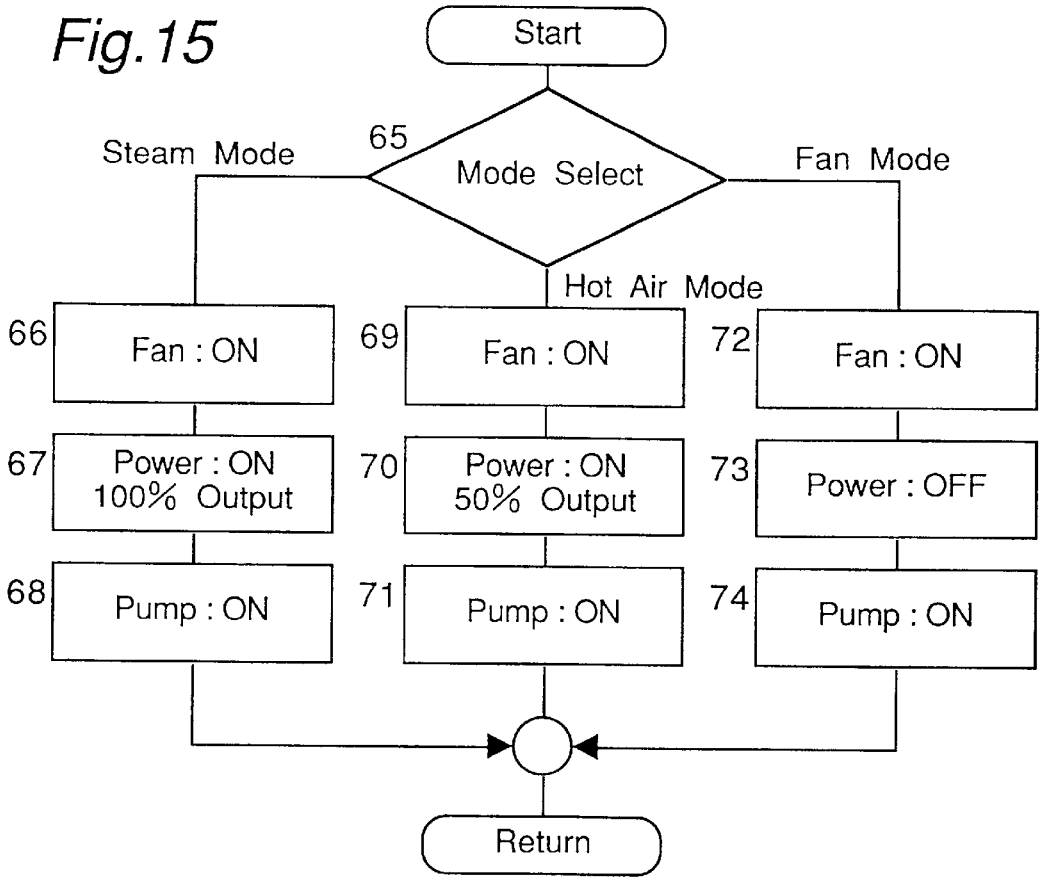
FIG. 15 is a flowchart showing the sequence of operation of the steam generator shown in FIG. 14.

The steam generator according to a seventh preferred embodiment of the present invention will now be described with reference to FIGS. 14 and 15. The steam generator shown therein comprises a heating chamber 49 for transforming water into steam and also for heating air. The exciting coil 17 is formed externally around the heating chamber 49 over a length thereof, and the cylindrical heating element 18 capable of being heated by the induction current which will be produced by the alternating magnetic field generated by the exciting coil 17 is disposed inside the heating chamber 49. A water supply means identified by 50 for supplying water into the heating chamber 49 includes a pump. This pump 50 is operable to pump water, which has been supplied into a supply tray 54 from a water reservoir 53, into an inflow tube 57 extending into the heating chamber 49 and opening downwardly towards the cylindrical heating element 18 within the heating chamber 49. Reference numeral 51 represents a blower means in the form of a fan for creating a draft of air flowing through the heating chamber 49. The heating chamber 49 has an inflow port 55 communicated with the fan 51 for the flow of the draft of air downwardly into the heating chamber 49 and an outflow port 56 defined at the bottom of the heating chamber 49 for the discharge of steam and heated air to the outside of the heating chamber 49.

The heating chamber 49 is defined by a generally cylindrical shell made of an insulating material of a kind having a heat resistance and an insulating property such as, for example, heat-resistant glass or porcelain, having a wall thickness greater than the distance of insulation relative to the voltage applied to the exciting coil 17, that is, greater than a value sufficient to avoid any possible dielectric breakdown which would take place at the voltage applied to the exciting coil 17.

The heating element 18 may be made of a porous metallic material having a sufficient water-resistance and a corrosion resistance such as, for example, Ni, Ni—Cr alloy or stainless alloy and is substantially identical to that shown in and described with reference to FIG. 2.

The exciting coil 17, the pump 50 and the fan 51 are controlled by a control means 52 which comprises a pump drive circuit 58 for driving the pump 50 to supply water in a variable quantity, a high frequency power circuit 59 for applying the AC power to the exciting coil 17, a fan drive circuit 60 for driving the fan 51, a setting circuit 60 which is a selector, and a control unit 62 which forms a steam amount adjusting means and which is operable according to a setting of the setting circuit 61 to control the pump drive circuit 58, the high frequency power circuit 59 and the fan drive circuit 60. The control means 52 also comprises a temperature detecting circuit 64 including a temperature sensor 63 disposed in the vicinity of the outflow port 56 for detecting the temperature of steam or heated air. The temperature detecting circuit 64 provides a temperature signal to the control unit 62 so that the pump drive circuit 58 and the high frequency power circuit 59 can be controlled according to the temperature of the steam or heated air then flowing through the outflow port 56.

The operation of the apparatus shown in FIG. 14 will now be described with reference to the flowchart shown in FIG. 15. At the outset, an operating mode must be set by the setting circuit 61 to supply a mode signal to the control unit 62. The control unit 62 executes the flow of FIG. 15 according to the mode signal supplied thereto from the setting circuit 61. At a decision block 65, one of a steam generating mode (Steam Mode), a hot air generating mode (Hot Air Mode) and a fan mode (Fan Mode) is selected according to the mode signal.

In the event that the Steam Mode is selected, the fan 51 is driven at a block 66, the high frequency power circuit 59 is operated at a block 67 to provide a 100% output, and the pump 50 is driven at a block 68. In the event that the Hot Air Mode is selected, the fan 51 is driven at a block 69, the high frequency power circuit 59 is operated at a block 70 to provide a 50% output, and the pump 50 is inactivated at a block 71. Finally, in the event that the Fan Mode is selected, the 51 is driven at a block 72, the high frequency power circuit 59 is inactivated at a block 73, and the pump 50 is inactivated at a block 74.

During the Steam Mode, the high frequency power circuit 59 operates to provide the 100% output to supply the AC power to the exciting coil 17. When the exciting coil, 17 is so energized, alternating lines of magnetic force develop around the exciting coil 17 so as to extend through the heating element 18. When the direction of the lines of magnetic force so developed alters according to the cycle of the AC power supplied to the exciting coil 17, electric forces develop in the heating element 18 to oppose the change in direction of the lines of magnetic force, thereby inducing in the heating element 18 an induction current flowing in a direction counter to the direction of flow of the current through the exciting coil 17. The induction current then flows through the fine wire elements forming the heating element 18 to cause the latter to be heated.

When the fan 51 is driven while the heating element 18 is heated in the manner described above, the resultant draft of air from the fan 51 flows through the inflow port 55 into the heating chamber 49. A major portion of the air flowing into the heating chamber 49 then flows through an annular gap between the heating element 18 and the cylindrical shell forming the heating chamber 49 and is then discharged to the outside through the outflow port 56. On the other hand, the remaining portion of the air flows through the open-celled pores of the heating element 18 and is therefore heated as it flow through the heating element 18. On the other hand, the water supplied by the pump 50 is supplied dropwise onto the heating element 18 through the inflow tube 57 and penetrates into the open-celled pores of the heating element 18. As the water droplets flow through the heating element 18, the water is heated to vaporize and the resultant steam emerges outwardly from the outflow port 56 in admixture with the heated air.

During the Hot Air Mode, the pump 50 is inactivated and, therefore, no water is supplied into the heating chamber 49. Therefore, it will readily be understood that only the draft of air generated by the fan 51 is heated to provide a hot air emerging outwardly from the outflow port 56. It is to be noted that since during the Hot Air Mode no steam need be generated, the output of the high frequency power circuit 59 is lowered, for example, 50% relative to its full output.

On the other hand, during the Fan Mode, only the fan 51 is driven and, accordingly, the draft of air produced by the fan 51 flows through the heating chamber 49 and emerges outwardly from the outflow port 56 without being heated.

According to the seventh embodiment of the present invention described above, the single heating means is effective to provide one or a mixture of the steam, the hot air and the draft of air to create an atmosphere of a varying condition in terms of humidity and temperature. Therefore, the seventh embodiment of the present invention when used in connection with cooking is applicable to a relatively wide range of food material such as, for example, steamed food items, baked food items and fried food items. Also, where it is applied in dish-washing or indoor cleaning, a mode selection among Wash, Sterilization and Dry is possible.

Also, since the water is directly dropped onto the heating element, the steam producing speed is high. In addition, since the steam is mixed with the heated air and since the resultant steam has a relatively low humidity or is a superheated vapor, condensation of the steam at the site of use thereof can be minimized and, therefore, no drain system for removing condensed water is needed.

A different embodiment of the control unit according to the present invention will now be described with particular reference to FIG. 16 which illustrates the flow of control performed by the control unit of the steam amount control means used in the steam generator. The embodiment of the control unit shown in FIG. 16 differs from that in the foregoing embodiment in that the amount of hear generated by the heating element 18 and the amount of water pumped by the pump 50 are controlled according to the temperature detected by the temperature sensor 63.

Figure 16:
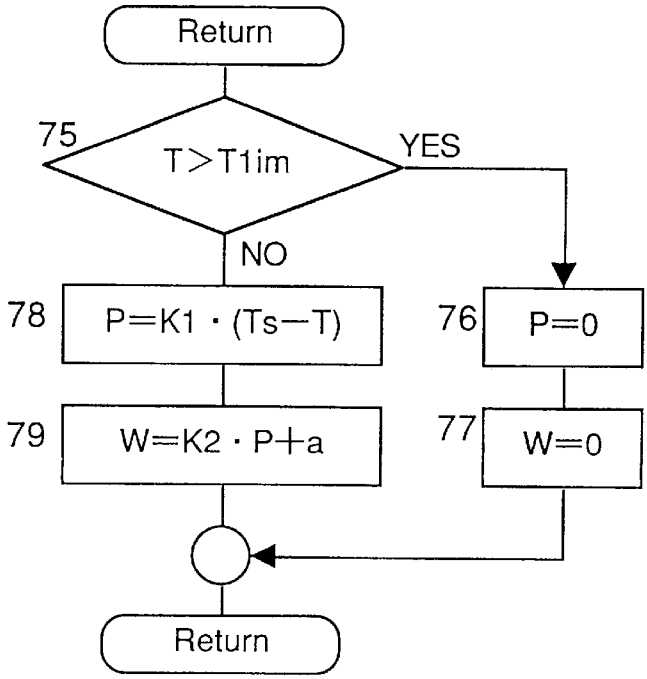
FIG. 16 is a flowchart showing a different embodiment of a control means utilizable in the steam generator of FIG. 14 for adjusting the amount of steam produced.

Referring to FIG. 16, in the event that at block 75 the temperature T detected by the temperature sensor 63 is found exceeding a critical temperature Tlim, a power output P of the high frequency power circuit 59 is interrupted at block 76 and an pump output W of the pump drive circuit 58 is also interrupted at subsequent block 77. On the other hand, should the temperature T be found lower than the critical temperature Tlim, the power output P is calculated at block 78 according to the following equation (1) so that the power output P can be controlled to render the temperature T to be equal to a preset temperature Ts set in the setting circuit 61.

$$P=K1\cdot(Ts-T) \tag{1}$$

wherein K1 represents a proportionality gain.

After the calculation of the power output P at block 79, the pump output W is calculated at block 79 according to the following equation (2) so that the power output P and the pump output W can be changed proportionally.

$$W=K2\cdot P+\alpha \tag{2}$$

wherein K2 represents a coefficient of proportionality and $\alpha$ represents an offset.

According to the embodiment of the control unit shown in FIG. 16, in the event that the temperature T detected by the temperature sensor 63 exceeds the critical temperature incident to failure of one or both of the high frequency power circuit and the pump or incident to clogging taking place in the heating chamber, the power output and the pump operation are advantageously halted for safeguarding purpose. Also, since the temperature of the fluid medium emerging outwardly from the outflow port is controlled to match with the preset temperature Ts, conditions of the steam or the hot air suited to a particular purpose of use can advantageously be maintained. Similarly, since the pump output W is varied in proportion to the electric power output P, conditions for balance between the steam and the hot air can also be maintained advantageously.

Figure 17:
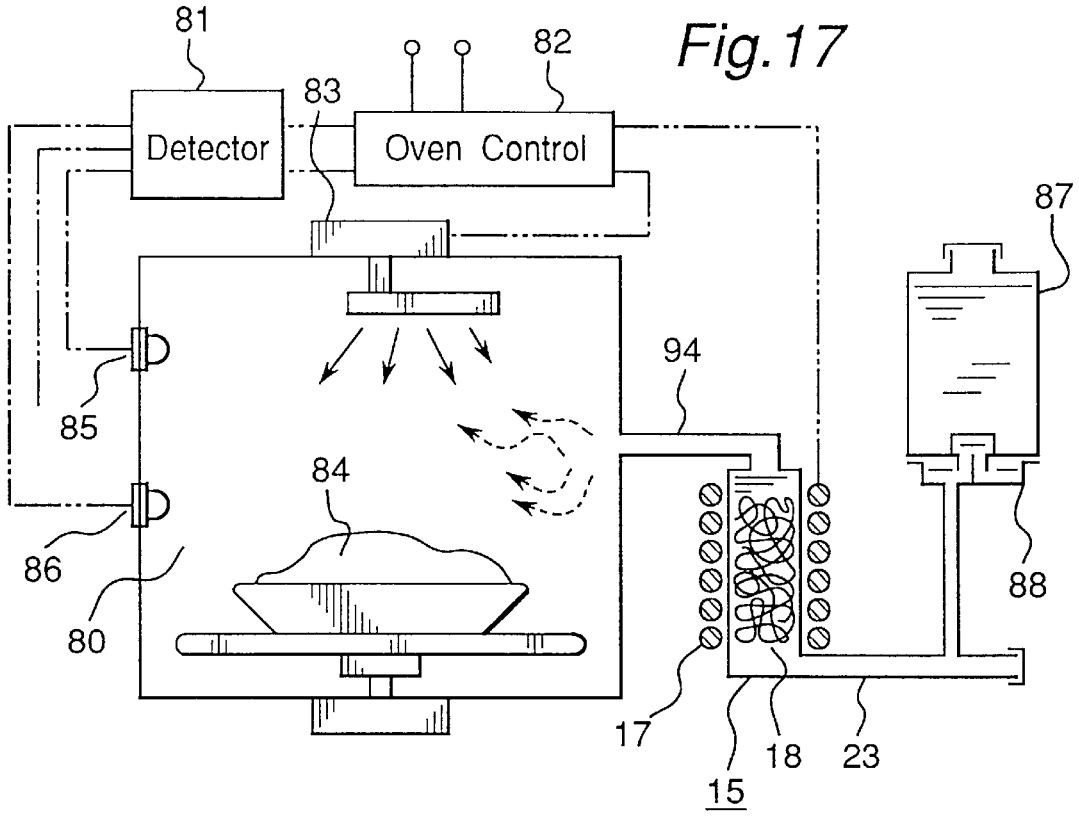
FIG. 17 is a schematic side sectional view of a microwave heating oven equipped with the steam generator.

FIG. 17 illustrates an example of application of the steam generator to a microwave heating oven. The steam generator 15 shown therein may be the one shown in and described with reference to FIGS. 1 and 2 and, for the water source, a water reservoir 87 is employed. The water reservoir 87 is fluid-coupled with the inflow tube 23 through a receptacle 88 of a design capable of retaining a quantity of water at a predetermined level by the effect of an interaction between the water head in the reservoir 87 and the atmospheric pressure acting on the surface of the water within the receptacle 88. For this purpose, the water reservoir 87 has a discharge port defined at the bottom thereof and is removably mounted on the receptacle 88 with the discharge port oriented downwards as shown, the level of water within the receptacle 88 being determined by the position of the discharge port of the water reservoir 87. In any event, instead of the use of the water reservoir 88 in combination with the receptacle 88, any suitable water supply means such as discussed with reference to FIG. 1 or FIG. 11 may be equally employed.

The microwave heating oven may be of any known structure and comprises a heating chamber defining structure having a microwave heating chamber 80 defined therein, a microwave generator 83 in the form of, for example, a magnetron 83 mounted atop the heating chamber defining structure, an oven control 82 and a detecting circuit 81 electrically coupled with a humidity sensor 85 and a condition sensor 86. The humidity sensor 85 is used to detect, and output a humidity signal indicative of, the humidity within the heating chamber 80. The humidity signal from the humidity sensor 85 is supplied to the detecting circuit 81. The oven control 82 operates in response to a control signal from the detecting circuit 81 to control the steam generator 15 to adjust the amount of steam, introduced into the heating chamber 80 through the discharge tube 94, to a preset value.

The condition sensor 86 is used to detect at least one of parameters associated with a food material 84 being heated within the heating chamber 80. Such parameters include the amount of gas produced by the food material 84 being heated, the amount of steam produced by the food material 84 being heated, the temperature inside the heating chamber 80, the water content and the pressure. The condition sensor 86 also provides a condition signal to the detecting circuit 81. The detecting circuit 81 in turn operates in response to the condition signal from the condition sensor 86 to control the steam generator 15 and the microwave generator 83 to automatically adjust the extent to which the food material 84 is humidified and heated.

The microwave heating system of FIG. 17 operates in the following manner. Assuming that a power source device of the system is powered on in response to a drive signal, the AC power is supplied to the exciting coil 17 to cause the latter to produce alternating magnetic field. As discussed hereinbefore, upon generation of the alternating magnetic field, the heating element 18 is heated by the induction current induced therein to thereby heat and vaporize water supplied from the water reservoir 87 through the receptacle 88. As the heating proceeds, the water so heated is vaporized to form steam which is in turn introduced into the heating chamber 80 through the discharge tube 94 to create a humid atmosphere within the heating chamber 80.

In a manner well known to those skilled in the art, the food material 84 placed inside the heating chamber 80 is heated by microwaves generated by the microwave generator 83 and also by the steam introduced into the heating chamber 80.

The humidity signal generated by the humidity sensor 85 is supplied to the detecting circuit 81 which supplies an output signal to the oven control 82 providing the control signal by which the amount of steam produced by the steam generator 15 is controlled to a preset value appropriate to the kind and the quantity of the food material 84. When a preset length of time during which the microwave heating in combination with the steam is carried out elapses, the microwave heating operation terminates automatically in response to the signal supplied from the condition sensor 86.

According to the example shown in FIG. 17, the food material can be heated not only by the microwaves generated by the microwave generator, but also by a high heat capacity of latent and sensible heat brought about by the steam around the food material being heated inside the oven heating chamber and, therefore, the food material can be cooked considerably quickly. Also, since the heating element is heated according to the induction heating system, steam production takes place quickly to allow the humidification to take place substantially simultaneously with the microwave heating so that a well balanced cooking condition can be created inside the heating chamber.

Figure 18:
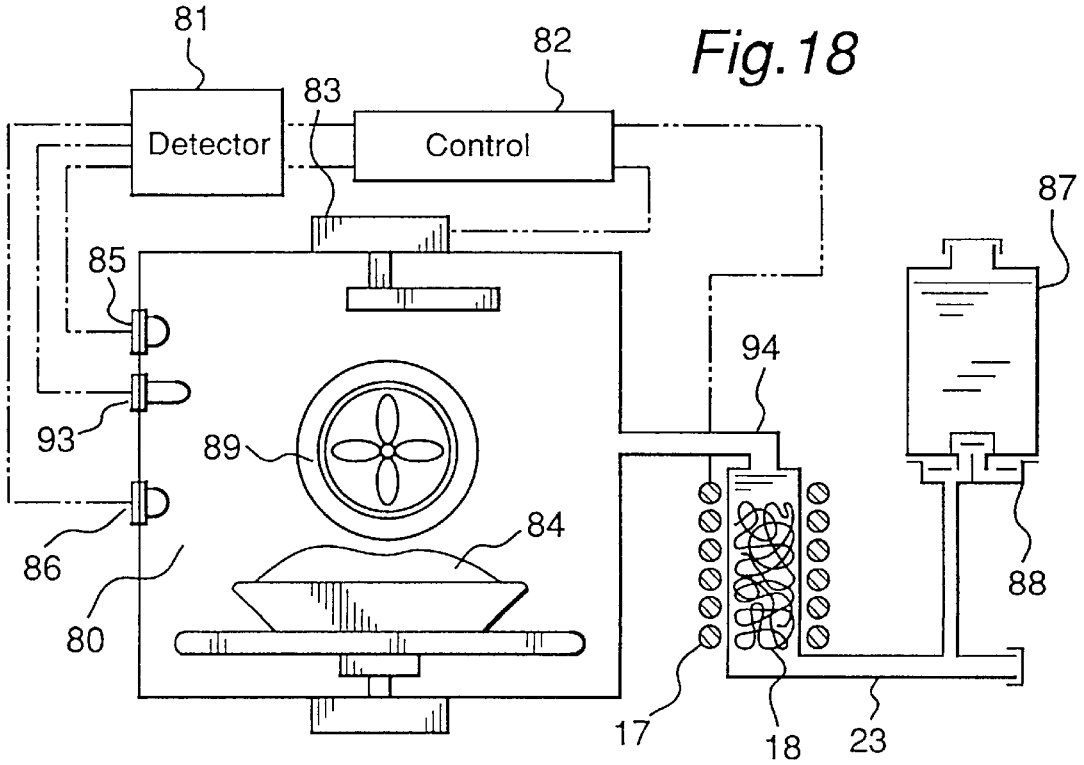
FIG. 18 is a schematic side sectional view of a different microwave heating oven equipped with the steam generator.
Figure 19:
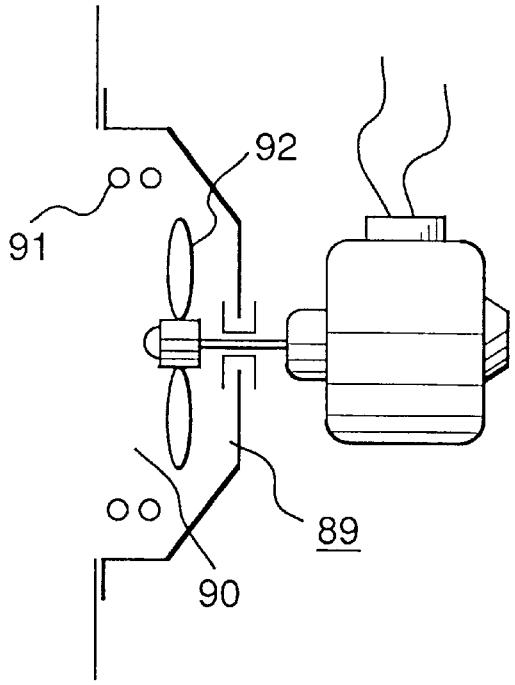
FIG. 19 is a schematic side sectional view of a portion of the microwave heating oven of FIG. 18, showing an installation of an oven heater inside the microwave heating oven.
Figure 20:
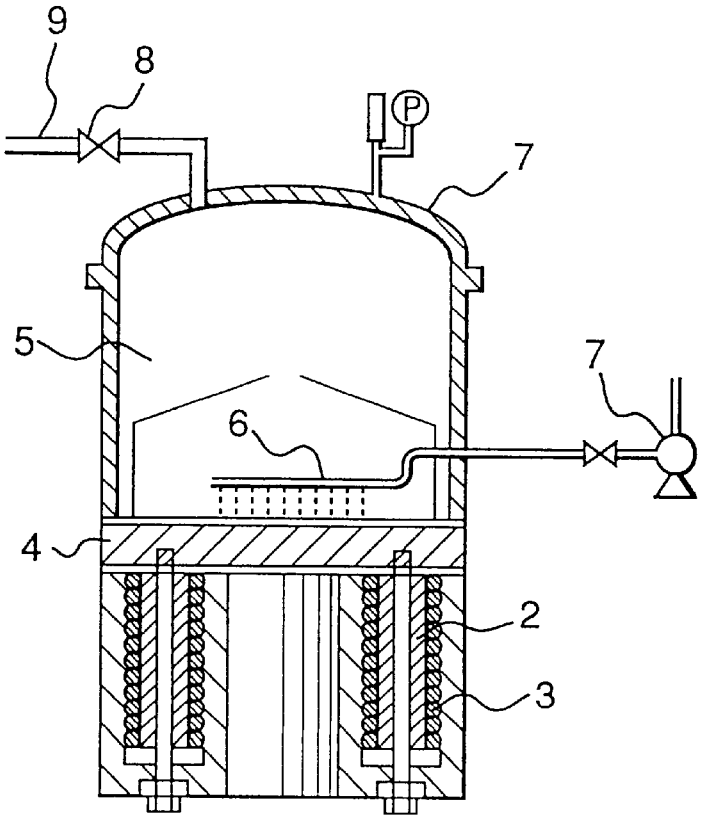
Fig.20 PRIOR ART
FIG. 20 is a schematic longitudinal sectional view of the prior art steam generator.
Figure 21:
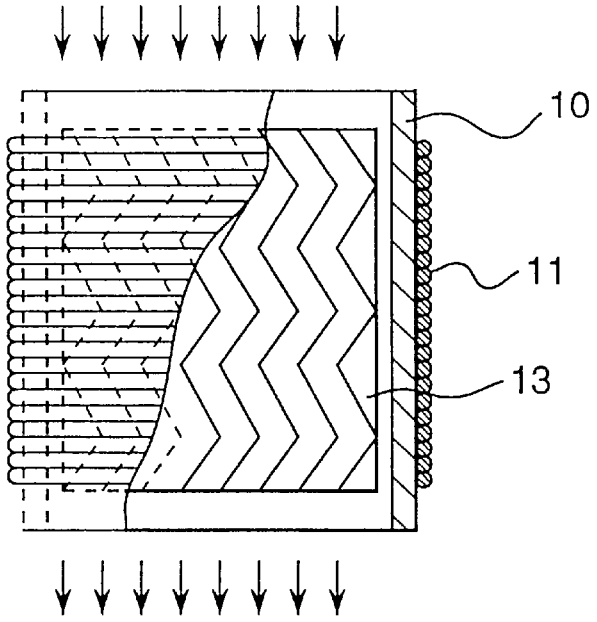
Fig.21 PRIOR ART
FIG. 21 is a schematic sectional view, with a portion cut away, of the prior art heating element.
Figure 22:
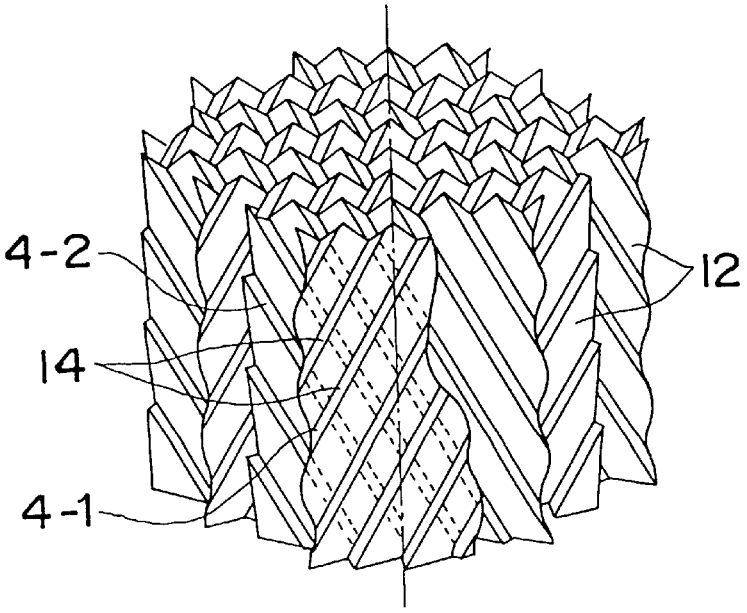
Fig.22 PRIOR ART
FIG. 22 is a perspective view showing a laminated filler used in the prior art heating element shown in FIG. 21.

Another example of application of the steam generator to a microwave heating oven. As is the case with the foregoing example shown in FIG. 17, the steam generator 15 shown therein may be the one shown in and described with reference to FIGS. 1 and 2. The microwave heating system shown in FIG. 18 is substantially similar to that shown in FIG. 17, except that in the system of FIG. 18 the microwave oven additionally comprises a temperature sensor 93 for detecting, and generating a temperature signal indicative of, the temperature inside the oven heating chamber 80, and an electric heating means 89 as best shown in FIG. 19. The electric heating means 89 includes an air heating cavity 90 defined in a portion of one of side walls of the microwave heating chamber in communication with the microwave heating chamber 80, a heater 91 positioned within the air heating cavity 90 and a motor-driven fan 92 for circulating air, heated by the heater 91, within the microwave heating chamber 80.

The electric heating means 89 is controlled by a control signal supplied from the oven control 82, which receives a control signal from the detecting circuit 81, so that the temperature inside the oven heating chamber 80 and the amount of steam introduced into the oven heating chamber 80 can be controlled to respective preset values.

The microwave heating system of FIGS. 18 and 19 operates in the following manner. Assuming that a power source device of the system is powered on and the electric heating means 89 is therefore activated, the heater 91 is energized and, at the same time, the fan 92 is driven to circulate air, heated by the energized heater 92, within the microwave heating chamber 80. On the other hand, when the AC power is supplied to the exciting coil 17 to cause the latter to produce alternating magnetic field. As discussed hereinbefore, upon generation of the alternating magnetic field, the heating element 18 is heated by the induction current induced therein to thereby heat and vaporize water supplied from the water reservoir 87 through the receptacle 88. As the heating proceeds, the water so heated is vaporized to form steam which is in turn introduced into the heating chamber 80 through the discharge tube 94 to create a high-temperature and humid atmosphere within the heating chamber 80.

In a manner well known to those skilled in the art, the food material 84 placed in the high-temperature and highly humid atmosphere inside the heating chamber 80 is heated by microwaves generated by the microwave generator 83 and also by the high-temperature steam introduced into the heating chamber 80. The extent to which the food material 84 is heated and the amount of steam needed to be introduced into the microwave heating chamber 80 are determined depending on the type and the quantity of the food material. The microwave heating system has a capability of selectively performing a steam heating at a low temperature of, for example, 60 to 70° C., a superheated steam heating at a temperature of, for example, 150 to 200° C. or a combination thereof.

According to the example shown in FIGS. 18 and 19, not only can the a uniform distribution of temperature inside the microwave heating chamber 80 be attained by the circulation of the heated air, but also a favorable transmission of heat to the food material or any other article being heated can be achieved to facilitate the cooking.

INDUSTRIAL APPLICABILITY (1) Since the heating element within the heating chamber is heated according to the induction heating system to heat water and air in contact with the heated heating element, the speed of increase of the temperature and the steam producing speed are high.

Also, in view of the induction heating system, no line breakage would occur in the heating element and, since the exciting coil and the heating element are insulated from each other by the wall of the heating chamber made of insulating material, any possible water leakage and an accident which would be caused by an electrical leak can be eliminated, thereby increasing the reliability.

(2) Since the heating chamber is made of magnetizable material and the exciting coil is mounted externally around the heating chamber with the intervention of the thermal insulating layer therebetween to allow the heating chamber to be heated directly by the magnetic induction current so that steam and hot air can be produced by the heat evolved within the heating chamber, no heating element is needed, enabling the apparatus to be simple in structure and to be assembled at a reduced cost.

(3) By defining a fluid path adjacent the exciting coil, the exciting coil can be cooled by a liquid medium having a high heat capacity. Consequently, the amount of power to be inputted to the exciting coil can be increased, making it possible to reduce the size of the apparatus and to increase the capacity thereof.

(4) Since the heating element is made of the porous metallic material, having the porous serving as heat conducting areas sufficient to increase the surface area of contact with the air and the steam, the efficiency of steam production and the heating efficiency can be increased considerably.

Also, considering that the porous metallic material has a relatively low heat capacity and a high efficiency characteristic, a heating control of a high response can be accomplished. In addition, since the heating load per unitary volume can be increased, the heating element and, hence, the steam generating chamber can ba made compact.

(5) Since the heating element is made of fibrous metallic material, no special mold is needed and the size and the shape of the heating element can be varied as desired.

Also, since adjustment is possible in such a way as to densely packing the fibrous metallic material which forms an outer peripheral region of the heating element capable of providing a high heat release value according to the induction heating system, the thermal efficiency can be increased and the magnetic coupling with the exciting coil can be adjusted simply.

(6) since the heating element is of a generally cylindrical shape having been made of magnetizable material, the magnetic circuit coupling between it and the exciting coil around the heating chamber can easily be obtained and, also, a freedom of design can be enjoyed in such a way as to reduce the number of turns of the exciting coil and/or to reduce the diameter of the heating element.

Also, since the heat radiating fin assembly is disposed within the cylindrical heating element, the surface area through which heat conducts can be increased without adversely affecting the induction heating, thereby increasing the heat exchanging efficiency.

(7) Since the water is supplied dropwise onto the heating element from the water supply means, an unreasonable heating of water occur to accomplish an efficient steam generation and to increase the steam producing speed.

(8) By setting the water level within an evaporating chamber at a position dividing the heating element, vaporization of water and vapor heating can be carried out simultaneously. Consequently, a superheated steam can be produced instantaneously. Also, by controlling the water level within the evaporating chamber, steam of a different characteristic ranging from a steam of a high humidity to a steam of a high dryness can be produced.

Also, vaporization of water and vapor heating takes place in the single heating element and, therefore, a loss of heat in the steam generating means can be minimized.

(9) By the use of a control means for controlling the heating means, the water supply means and the blower means, it is possible to create a varying condition in which different humidity and temperature of the steam, the hot air and the draft of air persist. Therefore, when the present invention is applied to cooking, it can be employed with a varying food material such as a steamed food, a roasted food and a fried food and, when it is applied to a dish washing or indoor cleaning, it can be used for washing, sterilizing and drying.

Also, with the single heating means, any suitable condition of a different temperature and a different humidity can be created and, therefore, the structure can ba made simple and compact.

(10) Since the control means is constituted by a switching means operable to select one of a steam generating mode in which the heating means, the water supply means the blower means are simultaneously operated, a hot air generating mode in which the water supply means is inactivated and the heating means and the blower means are operated, and a fan mode in which only the blower means is operated, not only can operating conditions be switched to suit to the food material to be cooked such as a steamed food, a roasted food or a fried food, but also selection of one of washing, sterilizing and drying modes is possible for dish washing or indoor cleaning.

In addition, where one of the modes is selected by the switching means, the amount of heat produced by the heating means can be varied according to the selected mode and, therefore, mode selection suited to the condition of use can be accomplished.

(11) The steam amount adjusting means is so designed as to proportionally vary the amount of heat produced by the heating means and the amount of water supplied by the water supply means. Accordingly, when the amount of heat is increased or decreased, the amount of water correspondingly increase or decrease, respectively, and therefore, a condition in which the steam and the hot air are well balanced relative to change in amount of heat can be maintained.

(12) The steam amount adjusting means is so designed as to adjust the amount of heat produced by the heating means and the amount of water supplied by the water supply means according to the temperature detected by the temperature detecting means. Therefore, the temperature of the steam and the temperature of the hot air, both suited to a particular condition of use, can be obtained.

(13) The food material can be heated not only by the microwaves generated by the microwave generator, but also by a high heat capacity of latent and sensible heat brought about by the steam and, therefore, the food material can be cooked considerably quickly. Also, since the heating element is heated according to the induction heating system, steam production takes place quickly to allow the humidification to take place substantially simultaneously with the microwave heating so that a well balanced cooking condition can be created inside the heating chamber.

(14) The use of the air heating means within the microwave heating chamber to accomplish a combined heating using the microwaves and the high-temperature steam makes it possible to adjust the temperature and the amount of steam inside the microwave heating chamber to respective values suited for a particular kind and/or amount of the food material. Consequently, one or a combination of a dry heating using a dry steam, a steamed heating using a wet steam and a combination thereof can be selected as desired to facilitate an optimum speedy cooking appropriate to the kind and/or the amount of the food material.

We claim:

1. A microwave heating apparatus comprising:

an oven defining structure for accommodating an article to be heated;

a microwave heating means for heating the article within the oven defining structure;

a steam generating apparatus which includes:

a heating chamber;

an exciting coil disposed in the heating chamber; said exciting coil, when electrically energized by application of an electric power thereto, producing a magnetic field;

a porous heating element for emitting heat as a function of change in the magnetic field produced by the exciting coil; and a fluid supply means for supplying a fluid medium to the heating chamber from above the heating element in a dropwise fashion to allow the fluid medium to be heated in contact with the heating element; and a control means for controlling the microwave heating means and the steam generating means to adjust a condition inside the oven defining structure, whereby the article within the oven defining structure is heated by induction heating and a high temperature of the steam introduced into the oven defining structure.

2. The apparatus as claimed in claim 1, wherein the heating element is a block of porous metal having mutually communicated pores.

3. The apparatus as claimed in claim 1, wherein the heating element is a block of fibrous metallic material.

4. A steam generating apparatus comprising:

a heating chamber;

an exciting coil disposed in the heating chamber, said exciting coil, when electrically energized by application of an electric power thereto, producing a magnetic field;

a porous heating element for emitting heat as a function of change in the magnetic field produced by the exciting coil;

a fluid supply means for supplying a fluid medium in a dropwise fashion onto the porous heating element within the heating chamber;

a blower means for supplying a draft of air into the heating chamber; and a control means for controlling supply of the electric power to the exciting coil and the blower means.

5. The apparatus as claimed in claim 4, wherein said control means includes:

a switching means for selecting one of:

a steam generating mode in which the heating means and the fluid supply means and the blower means are operated simultaneously;

a hot air generating mode in which only the heating means and the blower means are operated while the fluid supply means is inactivated; and a fan mode in which only the blower means is operated.

6. The apparatus as claimed in claim 5, wherein said control means is operable to vary the amount of heat produced by the heating means according to one of the modes selected by the switching means in the event that the switching means selected such one of the modes.

7. The apparatus as claimed in any one of claims 1 to 4, wherein said control means includes a steam amount adjusting means for proportionally varying the amount of the electric power to be supplied to the exciting coil and the amount of the fluid medium to be supplied by the fluid supply means.

8. The apparatus as claimed in any one of claims 1 to 4, wherein said control mean includes:

a temperature detecting means for detecting the temperature of the fluid medium heated by the heating element; and a steam amount adjusting means for varying the amount of heat generated by the heating element and the amount of the fluid medium supplied by the liquid supply means according to the temperature detected by the temperature detecting means.

9. A microwave heating apparatus comprising:

an oven defining structure for accommodating an article to be heated;

a microwave heating means for heating the article within the oven defining structure;

a steam generating apparatus which includes:

a heating chamber;

an exciting coil disposed in the heating chamber; said exciting coil, when electrically energized by application of an electric power thereto, producing a magnetic field;

a porous heating element for emitting heat as a function of change in the magnetic field produced by the exciting coil; and a liquid supply means for supplying a liquid medium to the heating chamber from above the heating element in a dropwise fashion to allow the liquid medium to be heated in contact with the heating element;

an oven heating means for increasing the temperature inside the oven defining structure; and a control means for controlling the microwave heating means and the steam generating means and the oven heating means to adjust a condition inside the oven defining structure whereby the article within the oven defining structure is heated by induction heating and a high temperature of the steam introduced into the oven defining structure.

* * * * *